US006743098B2

(12) United States Patent
Urie et al.

(10) Patent No.: US 6,743,098 B2
(45) Date of Patent: Jun. 1, 2004

(54) BIOMETRIC ENABLED CASINO GAMING SYSTEM

(75) Inventors: Steve Urie, Reno, NV (US); Braun Martin, Auburn, CA (US)

(73) Assignee: Gamet Technology, Reno, NV (US)

( * ) Notice: Subject to any disclaimer, the term of this patent is extended or adjusted under 35 U.S.C. 154(b) by 0 days.

(21) Appl. No.: 10/133,506

(22) Filed: Apr. 26, 2002

(65) Prior Publication Data

US 2002/0160834 A1 Oct. 31, 2002

Related U.S. Application Data

(60) Provisional application No. 60/286,747, filed on Apr. 26, 2001.

(51) Int. Cl.[7] ..... A63F 9/24

(52) U.S. Cl. ..... 463/29; 463/42

(58) Field of Search ..... 463/12–13, 16–20, 463/22, 25, 29–30, 36–38, 40–43, 47; 902/3–6, 23

(56) References Cited

U.S. PATENT DOCUMENTS 5,766,076 A * 6/1998 Pease et al. ..... 463/27
5,800,268 A * 9/1998 Molnick ..... 463/40
6,302,793 B1 * 10/2001 Fertitta, et al. ..... 463/25
2002/0103028 A1 * 8/2002 Carter et al. ..... 463/42
2002/0132664 A1 * 9/2002 Miller et al. ..... 463/29
2002/0142846 A1 * 10/2002 Paulsen ..... 463/43
2002/0147600 A1 * 10/2002 Waters et al. ..... 705/1
2002/0155887 A1 * 10/2002 Criss-Puszkiewicz et al. ... 463/29
2003/0022719 A1 * 1/2003 Donald et al. ..... 463/42

* cited by examiner

*Primary Examiner*—Kim Nguyen
(74) *Attorney, Agent, or Firm*—McAndrews, Held & Malloy, Ltd.

(57) ABSTRACT

A system for tracking game play frequency in a casino game, said system including a central server networked to a game unit, and a kiosk associated with the game unit. The central server stores personal information and registration biometric data of a player, wherein the personal information includes accrued comp point information. The kiosk includes a biometric reader for receiving a biometric identifier of a player, at least one of the central server and the kiosk compares the registration biometric data with game unit biometric data extracted from the biometric identifier to determine comp points based on game play on the game unit.

20 Claims, 3 Drawing Sheets

BIOMETRIC ENABLED CASINO GAMING SYSTEM

RELATED APPLICATIONS

This application relates to and claims priority benefits from U.S. Provisional Patent Application No. 60/286,747 entitled "Biometric Enabled Smart Card Casino Gaming System," filed Apr. 26, 2001, which is incorporated by reference herein in its entirety.

BACKGROUND OF THE INVENTION

Embodiments of the present invention generally relate to casino gaming systems, and more particularly to a system and method of identifying and tracking gambling activity on casino gaming systems.

Electronic gaming machines (EGMs) have existed for decades. An EGM is a generic term for any electronic or electromechanical game that operates by chance and that rewards a player with game award credits. Typical EGMs include simulated reel slot machines, video poker, bingo, keno, blackjack and lottery. Typical EGMs are coin operated. That is, a player wishing to wager inserts a coin(s) into the EGM in order to play. Additionally, many EGMs are capable of receiving paper money in exchange for an opportunity to play.

Over the years, EGMs were developed that were capable of accepting substitutes for money. As gaming flourished, EGM operators sought to increase the efficiency of game play. For example, instead of using money to wager on an EGM, the use of credit cards was considered as a basis for activating game play. That is, a credit card could be used to insert credits into the machine. However, some laws within the United States limit, or even prohibit, the use of credit cards for paying off gaming debt. Thus, credit cards may not be a viable option for game play on an EGM due to legal restrictions.

Some gaming systems utilize casino debt cards. Typically, a player pre-pays for a debit card at the cashier's desk, or from a vending machine. The card is then inserted into an EGM, which electronically reads the amount paid for the EGM and deducts the cost of game play from the card. If a player wins, additional funds are added to the debit card. At the end of game play, the debit card is "sold" to an operator for cash.

Tickets or vouchers are also used for gaming. In this case, an EGM is wired to accept a ticket/voucher. Through a variety of methods, the monetary value of the ticket is transferred to the EGM. Unfortunately, however, the tickets/vouchers, much like cash, may be lost, stolen or destroyed. Additionally, if the EGM runs out of paper to print the tickets/vouchers, the system typically requires an attendant to insert more paper into the machine. Thus, additional time and resources are needed to maintain the ticket/voucher EGM. Also, the tickets/vouchers typically must be stored after redemption. While the ticket/voucher method may be used with EGMs, the system typically is not conducive to table games, such as blackjack or poker.

Additionally, many casinos and other gaming locations issue player cards that are used to store information regarding game play frequency. The casino typically awards, or "comps," players for predetermined levels of play. Typically, the player cards are used in conjunction with gaming tokens or cash. That is, in order to play, a player still inserts money, tokens, or representative media into the EGM, while also inserting the player card into a separate card receptacle.

Typical electronic casino gaming carries heavy labor and capital costs. In addition to the heavy labor and capital costs, typical electronic casino gaming systems are inflexible in terms of game selection and updates. Due to the high cost of EGMs, a gaming location, such as a casino or bar operator may contract with a route operator who pays for the initial machine costs and supplies, and continuous service/maintenance in exchange for a percentage of gaming revenue.

The daily operating costs of electronic casino gaming are high, as an extensive labor force is required to handle the continuous movement of money between the EGMs, count room, and depository, for example. In some jurisdictions, jackpots over a certain amount are paid by a driver dispatched by the route operator to the location of the jackpot. Not only are employees needed to move the money, additional personnel are typically required to monitor all of the ensuing transactions. Such transactions include removing money from the EGMs, counting the money, wrapping and depositing the money, and refilling the EGMs. All of this money handling requires a heavy investment in security surveillance equipment and personnel. Additionally, personnel are typically needed to repair and service machines in the event of a coin jam or other such malfunction.

Additionally, the slot operation business is often a prime target for theft. Because of the large amounts of money that are continually moved between machine and depository, employees in charge of handling the money are often suspected, and sometimes rightfully so, of theft. Also, countless schemes by casino and bar patrons have been devised and implemented to steal money from the casino. Sometimes, the schemes to steal bear fruit.

Thus, a need exists for a more efficient system and method of cashless gaming. Also, a need exists for a more efficient system and method of voucherless gaming. Additionally, a need exists for a more flexible system and method of casino gaming. Moreover, a need exists for a more safe system and method of casino gaming that reduces the risk of theft.

BRIEF SUMMARY OF THE INVENTION

Embodiments of the present invention provide a system for tracking game play frequency in a casino game. The system includes a central server networked to a game unit and a kiosk associated with the game unit (for example, a video poker machine, or a blackjack table). The central server stores personal information and registration biometric data of a player. The personal information includes accrued comp point information. The kiosk associated with the game unit includes a biometric reader for receiving a biometric identifier of a player. At least the central server or the kiosk compares the registration biometric data with game unit biometric data extracted from the biometric identifier to determine comp points based on game play on the game unit. The comp points are then attributed to the player.

Figure 1:
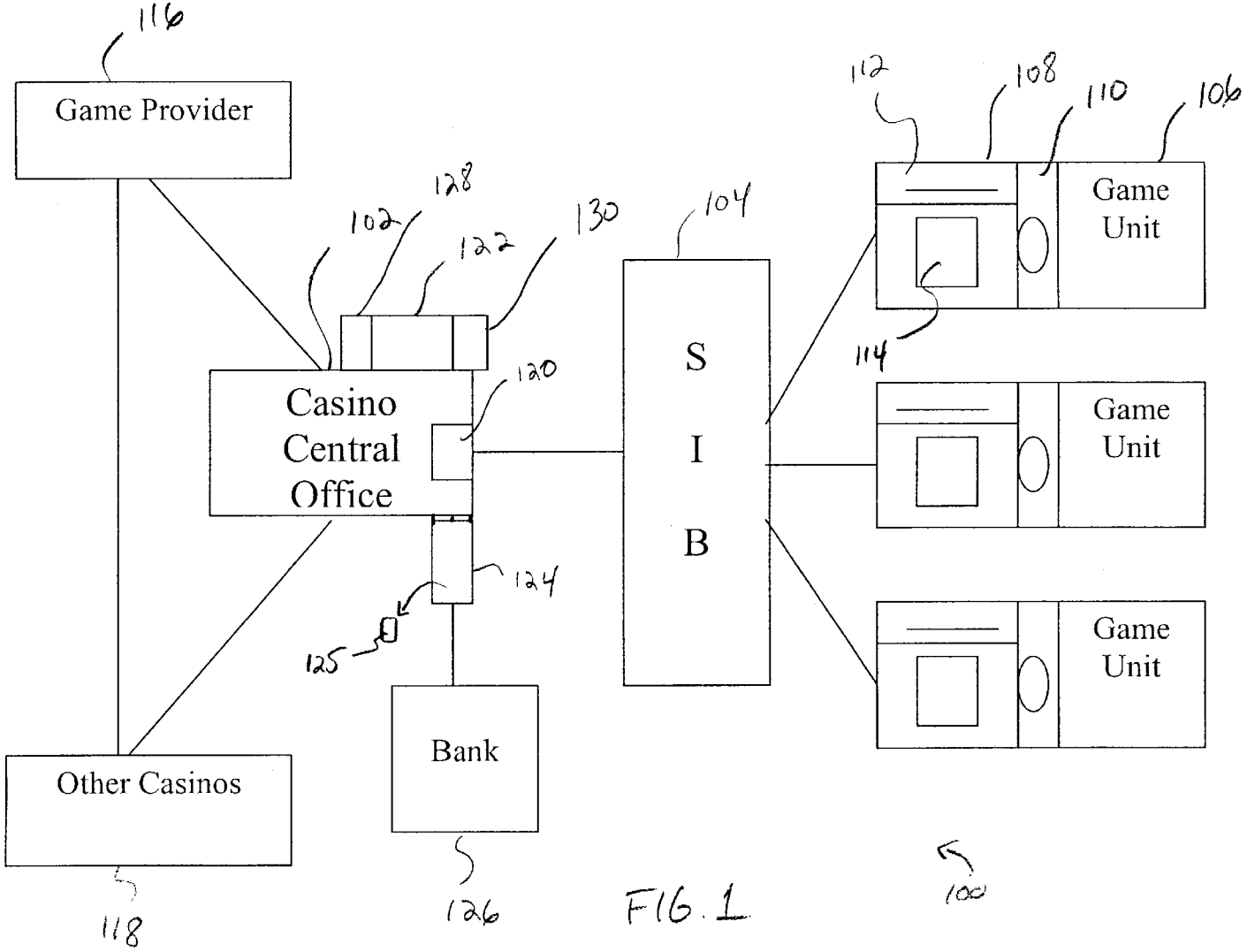
FIG. 1 illustrates a gaming system according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a gaming system 100 according to an embodiment of the present invention. The gaming system 100 includes a casino central office 102, a system interface board (SIB) 104 electronically connected to the casino central office 102, a plurality of game units 106 having associated kiosks 108 (having central processing units) electronically connected to the SIB 104, a game provider 116, other casinos 118, or gaming centers, and a bank, or personal account center 126. Each kiosk 108 includes a smart card, or chip card, reader (card reader) 112, a biometric reader 110 and a display 114.

The casino central office 102 includes at least one secured server 120, an authorization unit 122, and a chip card distribution system 124, which is electronically connected to the bank 126. The authorization unit 122 includes an authorization biometric reader 128 and an input device 130. The authorization unit 122 is electronically connected to the server 120 and the chip card distribution system 124. Further, the casino central office 102, in general may, be networked to the bank 126, or the bank 126 may be part of the casino central office 102. Additionally, the casino central office 102 is networked to the game provider 106 and other casinos 118. Additionally, the casino central office 102 is networked to the game units 106 and kiosks 108 through the SIB 104.

The SIB is used to convert an electronic communications protocol into another electronic communications protocol. Alternatively, the SIB may not be included in the system if there is no need to convert communications protocols.

Each game unit 106 includes a central processing unit that communicates with the central processing unit of the kiosk 108 associated with the game unit 106. The game units 106 may be at least one of a bingo, keno, table game, blackjack, video poker, or other such casino game, unit. If the game unit 106 is a table game, such as blackjack or poker, the dealer may input information on a computer having a central processing unit, which may communicate with the kiosk 108, and ultimately the casino central office 102. Because the casino central office 102 is networked to the game provider 116, the game provider 116 may update game selection on the game units 106 at predetermined times.

For example, the game provider 116 may update a video poker game on a game unit 106 to a new version of the video poker game. Alternatively, the game provider 116 may substitute video poker on a game unit 106 for video slots. The casino central office 102 may request changes from the game provider 116, or the game provider 116 may unilaterally update or change games on the game units 106. Also, the casino central office 102 may change games on the game units 106. Further, the casino central office 102 may include a stored library of games that may be electronically sent to the game units 106. Additionally, a plurality of games may be programmed into each game unit 106. That is, each game unit 106 may allow a player to select from a plurality of casino games.

In order to begin play within the gaming system 100, a player first registers. A player may register at the casino central office 102, or at any other location that is networked into the casino central office 102. That is, a player may register at the authorization unit 122 of the central office 102, or any other location, which is networked to the gaming system 100, that enables a player to input personal information, such as name, address, etc., and biometric information, such as a unique biometric identifier. Included within the personal information is comp information, which keeps track of comp points, as discussed below.

Registration requires a player to input biometric data into the authorization unit 122. The authorization unit 122 registers the individual's biometric identifier, such as a fingerprint, via an authorization biometric reader 128. That is, an individual presents a biometric identifier to the authorizing biometric reader 128. Then, the authorization biometric reader 128 scans the individual's biometric identifier, such as a fingerprint, and captures various points of identification from the biometric identifier. That is, the authorization biometric reader 128 scans the biometric identifier and extracts the biometric indicators from the biometric identifier. The authorization biometric reader 128 subjects the biometric indicators to a recognition algorithm that converts the scanned biometric identifier image into a much smaller data code. The authorization biometric reader 128 then sends the smaller data code of biometric identification, or biometric data, to an authorizing storage unit within the authorization unit 122.

Next, a casino desk attendant (or the player) may input personal information such as name and address via the input device 130. The input device 130 may be a computer keyboard or touch-sensitive monitor. The personal information is then sent to the authorizing storage unit within the authorization unit 122. An encoder then receives the biometric data and the personal information from the authorizing storage unit. The personal information and the biometric data may then be encoded. That is, the encoder may then match and combine the personal information with the biometric data. The encoded personal information and biometric data are then stored within the casino central office 102 as tracking information within the server 120, or within another data storage unit capable of storing large numbers of such data. Once the personal information and biometric data have been matched and combined, registration is complete.

Additionally, the player may also set up an account with the casino. That is, the player may deposit an amount with the casino, which is then electronically transferred to the bank 126. The player may then be issued an account chip card 125 by the chip card distribution system 124. A chip card, or smart card, is a plastic card similar to a credit card that has an embedded microprocessor chip, having a memory (for example 256 K of memory), which allows for the encryption of transmitted data. The chip card may be used to access a players account at the bank 126. Alternatively, the account chip card 125 may be used to access a player's own personal bank account. That is, while the casino central office 102 may have, or be networked with, a casino bank 126, the casino central office 102 may also be networked with financial institutions around the world. Thus, a player may be able to directly access personal finances at the player's personal financial institution through the account chip card 125.

The account chip card 125 issued to the player is linked, or associated, with the player's biometric data. That is, the account chip card stores the player's biometric data. The chip card distribution system 124 requires a player, or casino operator, to input a player's personal information, which is then associated with the account chip card 125. The personal information is then cross-linked to the biometric data of the player. That is, a player wishing to use the account chip card 125 may be required to input biometric data to extract funds from his account. Because the account chip card 125 may be associated with a player's biometric data, only the player may extract funds from the account chip card 125. In other words, if a thief tries to use the player's account chip card 125, the thief will not be granted access to the player's account because in order to use the account chip card 125, a kiosk 108 may require biometric data to activate the account chip card 125.

Preferably, unlike magstripe cards, which can store only 384 bytes of data (data that may be easily read or altered) the account chip card 125 is a smart card of the type which currently may store up to 256 kilobytes of memory, and are encrypted with a high level of security The biometric data input into the kiosk 108 must match the biometric data associated with the account chip card 125. Alternatively, because the biometric data may be stored on the account chip card 125, the kiosk 108 may perform an initial comparison between the biometric data on the account chip card 125 and the biometric data input at the game biometric reader 110. Also, The account chip card 125 may store accrued comp points. Thus, the account chip card 125 and a player's biometric data (stored in conjunction with a player's personal information as tracking information), such as a fingerprint, may be used to provide an efficient, safe and streamlined way of gaming.

The tracking information may be used to track the number of times the player has played. The tracking information, therefore, may be used to award a player comps, such as free drinks, meals, hotel stays, vacations, etc., based on the number of times a player plays. That is, the tracking information, whether stored on the account chip card 125 or on the server 120, keeps a running tally of comp points, which may be redeemed for comps.

Once the player is registered, the player may begin a gaming session. A player either inserts cash into the came unit 106, or inserts an account chip card 125 into the card reader 112. Either way, the display unit 114 then prompts the player to provide a biometric identifier to the game biometric reader 110. Alternatively, as mentioned above, the account chip card 125 may be inserted into the card reader 112. The player may then input biometric data into the game biometric reader 110. The kiosk 108 may then compare the input biometric data with that stored on the account chip card 125. If the player is using cash and does not want to be "tracked," (or if the player never registered), the player may opt to not provide a biometric identifier to the game biometric reader 110. That is, the kiosk 108 may include a bypass mechanism (such as a button, or touchscreen), which allows the player to bypass comp accrual (that is, storing game play points for frequency of play within the player's tracking information) and/or streamlined methods of paying for game play.

If the player wants to accrue game play points (comp points), the player provides biometric data, such as a fingerprint, to the game biometric reader 110. The game biometric reader 110 scans the biometric identifier. The game biometric reader 110 subjects the biometric indicators of the biometric identifier to a recognition algorithm that converts the scanned biometric identifier image into a much smaller data code. The game biometric reader 110 then sends the smaller data code of biometric identification, or biometric data, to a storage unit within the kiosk 108. The kiosk 108 then communicates with the casino central office 102.

The server 120 searches for matching biometric data stored within the server 120 or elsewhere in the computer system of the casino central office 102. The server 120 then communicates with the kiosk 108 as to the identity of the player. If a match between the biometric data input at the game biometric reader 110 and the biometric data stored in the casino central office exists, the display 114 on the kiosk 108 may display the player's name and the player's comp points. If no match exists, the display 108 may display an appropriate message informing the player that there are no records for the player. Alternatively, as mentioned above, if an account chip card 125 is used, the kiosk 108 may perform a local comparison between the biometric data input at the kiosk 108, and the biometric data stored on the account chip card 125. Then, if a match exists, the kiosk 108 may retrieve account and/or comp point information from the server 120.

Once a match has been confirmed, the player begins to wager on the game unit 106 (and subsequently play the selected game). A predetermined number of comp points is associated with each wager. A player may be required to provide a biometric identifier with each wager. Alternatively, the player may input biometric data once in a gaming session, and then engage a discontinue button on the kiosk 108 when the player is finished with the gaming session. Also, alternatively, the kiosk 108 may terminate a player's gaming session after a predetermined period of inactivity. The kiosk 108 may transmit the accrued amount of comp points to the casino central office 102 each time a player wagers, or the kiosk 108 may store the accrued amount of comp points for a particular length of time within the central processing unit of the kiosk 108. Then, the kiosk 108 may transmit the total number of accrued comp points within a gaming session at predetermined times, or when the player is finished gaming on the associated game unit 106.

The player may redeem comp points at stations within the casino. For example, the casino may include biometric readers within restaurants, or bars, within the casino. The player may input biometric data at the biometric readers to pay for food, beverages, etc. Also, the player may input biometric data at the casino central office 102 to view the total amount of comp points accrued in order to find out if the player has accrued enough points for various other comps, such as free hotel stays or vacations to Las Vegas or Monte Carlo, for example. Thus, the use of biometric data and information replaces the use of magnetic cards for tracking player game play frequency and comp points. Because the player does not need a magnetic card to store tracking information and comp points, the player need not worry about losing the card. Consequently, keeping track of player game play frequency and comp points is more efficient.

As mentioned above, a player may also opt to use an account chip card as a substitute for cash, and as medium for storing accrued comp points. Because the account chip card is associated with the player's biometric data, theft of the account chip card will only result in theft of an amount equal to the card itself. If a player loses the account chip card 125, the player may notify the casino, which may retrieve the player's account and comp information (and subsequently issue the player a new card with the player's account and comp information).

Each time a player plays a game on a game unit 106, the player may use the chip card as a substitute for cash to play. In other words, because the game unit 106 and kiosks 108 are linked to the casino central office 102, funds may be extracted from a player's account at the bank 126 (or personal financial institution) upon game play. For example, as discussed below, if a player wishes to play video poker on a game unit 106, the player inserts the account chip card 125 into the card reader 112. The player then authorizes debits from the account (located at the bank 126 or personal financial institution) through biometric data. If the biometric data and information on the account chip card 125 and that stored in the server 120 of the casino central office 102 match, the game unit 106 communicates with the bank 126 (or personal institution) to debit the player's account for the cost of a game of video poker. If the player wins, a corresponding amount of winnings is credited to the account located at either the bank 126 or the player's personal financial institution. A player may be required to provide a biometric identifier with each wager. Alternatively, the player may input biometric data once in a gaming session, and then engage a discontinue button on the kiosk 108 when the player is finished. Also, alternatively, the kiosk 108 may terminate a player's gaming session after a predetermined period of inactivity.

If, however, the biometric data input at the game biometric reader 110 and the biometric data stored within the server 120 do not match, the player is not allowed to use the account chip card 125 as a way of paying for game play. Also, if a match does not exist, the server 120 may alert an electronic security post within the casino central office 102 that the player playing at the location of the game unit 106 is attempting to play with an account chip card that is not authorized for use by the player. Thus, the gaming system 100 provides a safer and more efficient way of paying for game play.

Alternatively, the biometric data of a player may be used to access a player's account. That is, instead of using the account chip card 125, the gaming system 100 may be set up such that a player's biometric data permits a player to gain access to the player's account. The kiosk 108 may prompt the player to choose a method of payment. The player may choose to debit an account at the bank 126, or the player's personal financial institution. In other words, during registration, the player may set up an account that is associated with the player's biometric data, thereby eliminating the need for a separate account chip card. Alternatively, the biometric data of a player alone may be used to access a player's account. That is, instead of using the account chip card 125, the gaming system 100 may be configured such that a player's biometric data permits a player to gain access to the player's account. The kiosk 108 may prompt the player to choose a method of payment. The player may choose to debit an account at the bank 126, or the player's personal financial institution. In other words, during registration, the player may set up an account that is associated with the player's biometric data, thereby eliminating the need for a separate account chip card.

For example, the play may proceed through the registration process much as discussed above by registering a biometric identifier at the central office 120. However, at the central office, the player may set up an account or make a deposit that is associated not with a smart card, but directly with the payer's biometric identifier. The player may then proceed to any game unit 106 and gain access to the game unit 106 via the biometric reader on the game unit 106. The game unit 106 sends the player's biometric data to the central office 120 and retrieves the player's account information including, for example, an account balance a comp or rewards balance, and a personal jackpot balance. As the player plays at the game unit 106, the updated balance and comp information may be relayed to the central office 120 for storage. In this fashion, the player is afforded great freedom around the casino and worries regarding the loss of smart cards are eliminated, as well as the cost of issuing smart cards and installing smart card systems.

Although the system of FIG. 1 has been described in terms of employing a biometric reader to perform positive identification. Any method of performing a positive identification may be substituted. For example, a positive identification may be obtained through the use of an encrypted smart card instead of through a biometric.

Figure 2:
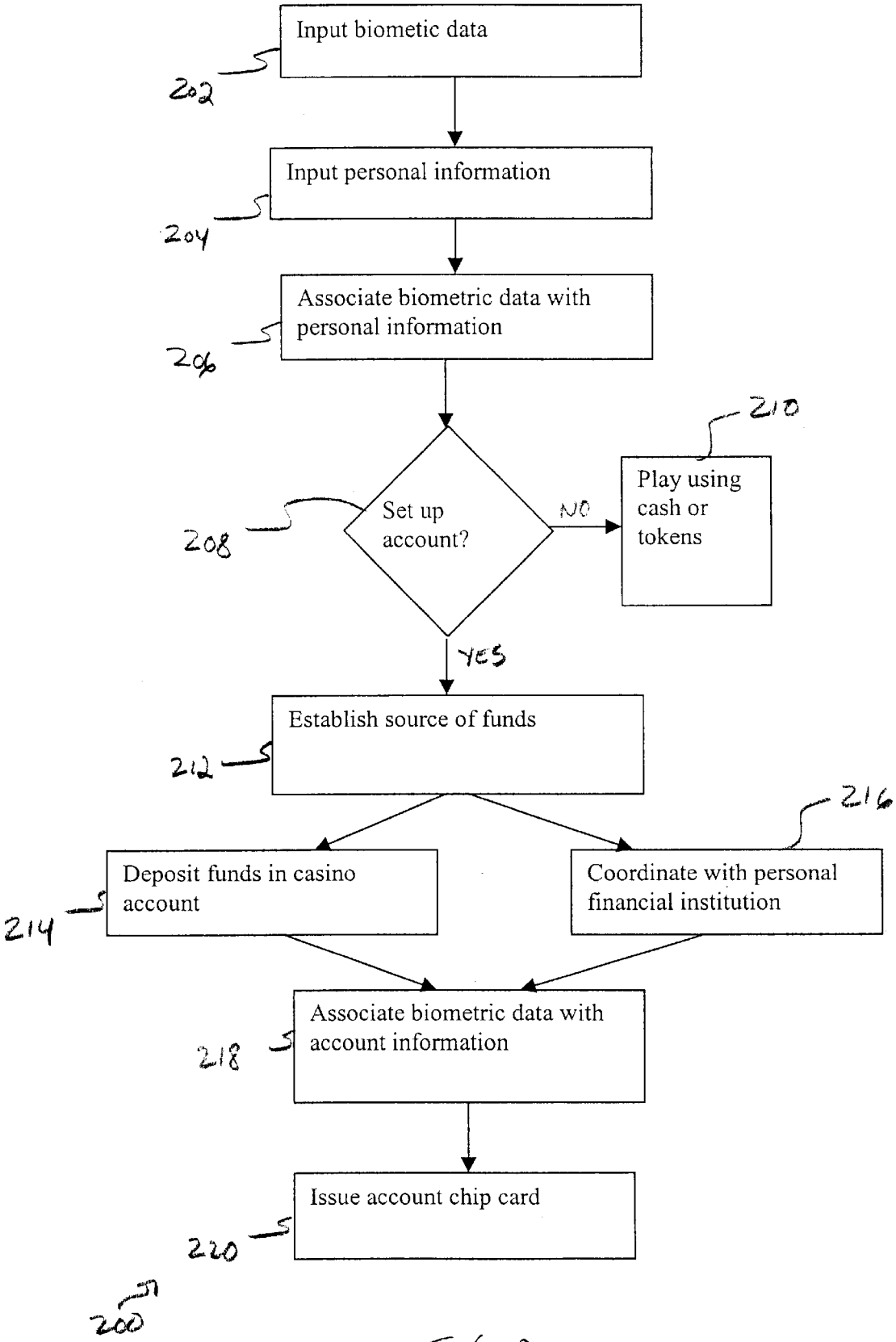
FIG. 2 is a flow chart of player registration according to an embodiment of the present invention.

FIG. 2 is a flow chart 200 of player registration according to an embodiment of the present invention. At 202, a player inputs biometric idea at an authorization unit. The player, or a casino operator, also inputs personal information, including name, address, social security number, etc. at step 204. At 206, the authorization unit associates the player's personal information and biometric data with one another. At 208, the player has an option to set up an account. If the player does not want to set up an account, the player may begin game play using cash or tokens at 210, while the player's biometric data may be used for tracking purposes, such as comp points. If, however, the player does wish to set up an account, the player may establish a source of funds at 212. The player may deposit fund in the casino's account at 214, or the player may coordinate with his personal financial institution at 216 such that he may draw directly from the institution. Either way, at 218, the casino central office associates the player's biometric data with the account information. Finally, at 220, an account chip card is issued to the player. The account chip card may be used for drawing from the player's account for gaming purposes (with winnings being credited to the account) and/or tracking of comp points. Either way, the account chip card must be used in conjunction with biometric data.

Similar to the system of FIG. 1, the flowchart of FIG. 2 has been described in terms of using a biometric to provide a positive identification of the player. However, any methodology of providing a positive identification of the player may alternately be applied. For example, an encrypted smart card may be employed to provide a positive identification of the player.

Figure 3:
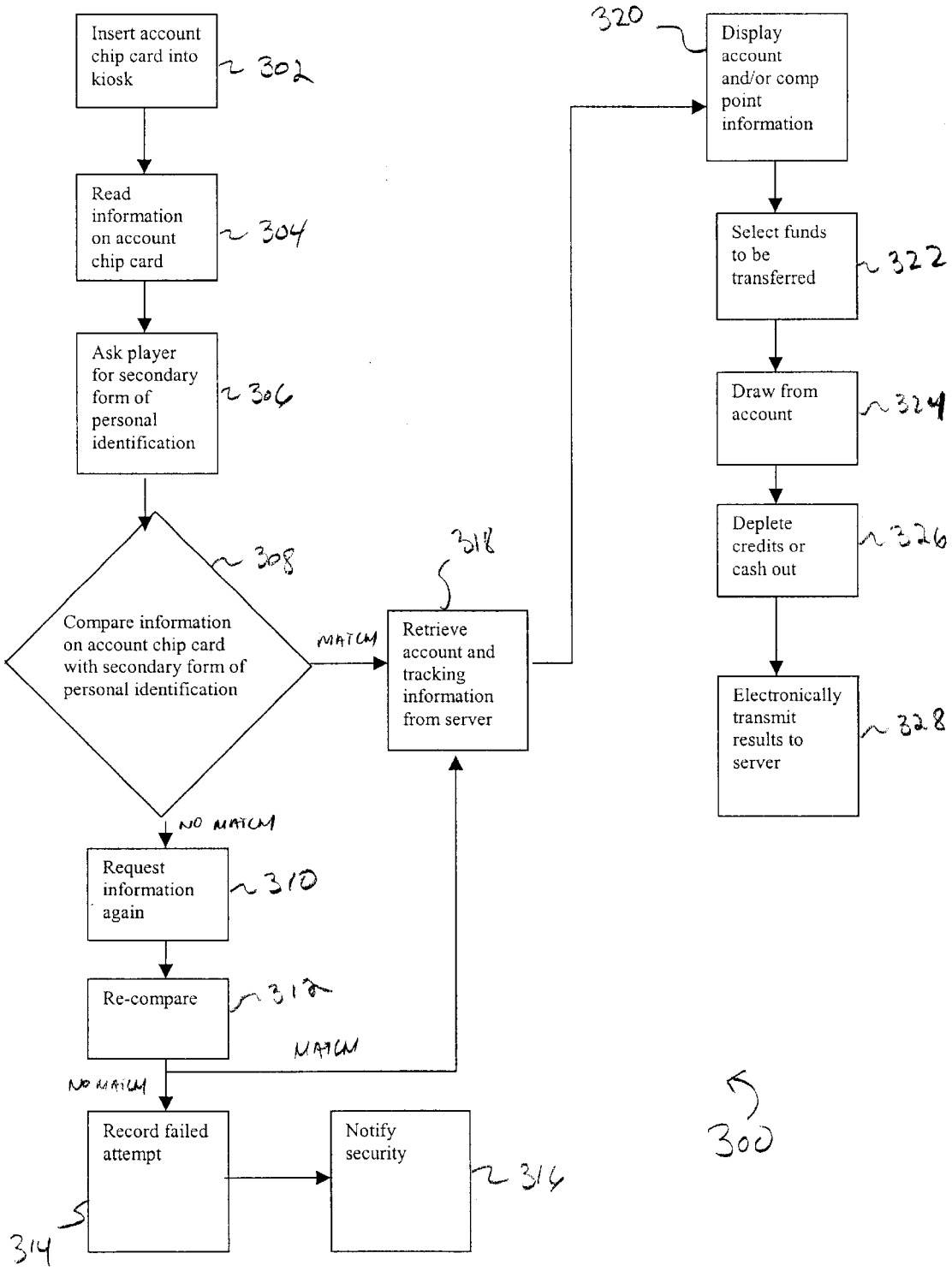
FIG. 3 is a flow chart of game play according to an embodiment of the present invention.

FIG. 3 is a flow chart 300 of game play according to an embodiment of the present invention. At 302, a player inserts an account chip card into a kiosk that is associated with a game unit.

Alternatively, the player may input biometric data, which is then compared to tracking and account information stored on the server. That is, because tracking information, including biometric data, personal information, comp points, etc. and account information may be stored on the server in the casino central office, the player may access the tracking information and account information through biometric data alone (as opposed to biometric data and the account chip card).

If, however, the account chip card is used, at 304, the kiosk reads information on the account chip card. The kiosk, at 306, asks, or prompts, the player for a secondary form of personal identification, such as a biometric identifier. The kiosk then compares the biometric data on the account chip with the secondary form of personal identification entered at the kiosk at 308.

Alternatively, as discussed above, the kiosk may bypass this step and forward the biometric data, that is the secondary form of identification, to the server. The server may then compare the secondary form of identification with the biometric data of the tracking information stored in the server. The server may then forward the results of the comparison to the kiosk.

If, however, the account chip card is used and the kiosk performs a local comparison, the kiosk determines if a match exists. If a match does not exist, the kiosk requests the secondary form of identification again at 310. At 312, the kiosk re-compares the secondary form of identification with the biometric data stored on the account chip card. If a match still does not exist, the kiosk records the failed attempt with the server at 314. Additionally, the server and/or the kiosk alerts security as to the failed attempt at 316.

On the other hand, if a match does exist, the kiosk retrieves account and tracking information from the server at 318. The kiosk displays the retrieved account and/or comp point information at 320. At 322, the player then selects the funds to be transferred to the kiosk. That is, the player decides how much to wager. At 324, a corresponding amount of funds are drawn from the player's account. At 326, the player continues to play until credits are depleted, or until the player decides to cash out. At 328, the kiosk electronically transmits the results of the gaming session to the server. The results may be transmitted after each round or hand, or at the end of the player's gaming session. The player may then redeem comp points by inserting the account chip card and/or inputting biometric data at appropriate terminals.

Thus, embodiments of the present invention provide a system and method that allows for more efficient and safer gaming because access to player information and accounts is tied to biometric data.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A system for game play in a casino game, said system including:

a central server networked to a game unit, said central server storing personal information and registration biometric data of a player, said personal information including accrued comp point information;

a kiosk associated with said game unit, said kiosk including a biometric reader for receiving a biometric identifier of the player, at least one of said central server and said kiosk comparing said registration biometric data with game unit biometric data extracted from said biometric identifier to determine comp paints based on game play on said game unit; and a bank remote from said game unit, wherein said player is provided with access to a financial account of said bank based on the comparison of said registration biometric data with said game unit biometric data at said kiosk.

2. The system of claim 1 further including an account chip card, said account chip card storing account information and card biometric data of said player, said kiosk including a card reader for receiving said account chip card, said kiosk comparing said game unit biometric data and said card biometric data to determine access to said account information.

3. The system of claim 1 wherein said game unit is at least one of a slot, video poker, keno, bingo, blackjack, roulette and craps unit.

4. The system of claim 1 further including a bank networked with said central server, at least one of said central sewer and said kiosk comparing said registration biometric data with said game unit biometric data extracted from said biometric identifier to determine access to funds deposited in said bank.

5. The system of claim 1 wherein said central server transmits comp point information to said kiosk when said registration biometric data and said game unit biometric data match.

6. The system of claim 1 further including a plurality of casinos, wherein said central server is networked to plurality of casinos, said central server communicating with said plurality of casinos.

7. The system of claim 1 further including a game provider, said game provider networked to said central server, at least one of said central server and said game provider updating games on said game unit.

8. The system of claim 1 further including a plurality of game units and a plurality of kiosks associated with said game units.

9. An improved method of game play in a casino gaming system, said method including:

registering a first set of biometric data;

associating the first set of biometric data with personal information including comp information and user financial account information at a remote bank;

inputting a second set of biometric data into a kiosk that is associated with a game unit;

said kiosk comparing the first set of biometric data with the second set of biometric data; and determining access to the personal information based on whether the first set of biometric data matches the second set of biometric data.

10. The method of claim 9 wherein said associating step includes associating account information with said first set of biometric data; and wherein said determining step includes determining access to the account information based on whether the first set of biometric data matches the second set of biometric data.

11. The method of claim 9 further including storing the first set of biometric data on an account chip card.

12. The method of claim 9 further including accruing comp points based on at least the quantity and frequency of game play.

13. The method of claim 9 further including playing at least one of video poker, slots, roulette, blackjack, craps, keno, and bingo on the game unit.

14. The method of claim 9 further including displaying comp information at the kiosk when the first set of biometric data matches the second set of biometric data.

15. The method of claim 9 further including networking a plurality of gaming facilities, cach having a plurality of game units, together.

16. The method of claim 9 further including updating casino games on the game unit at predetermined times.

17. A system for game play in a casino game, said system including:

a central server networked to a game unit, said central server storing personal information and first biometric data of a player, said personal information including accrued camp point information and user financial account information at a remote bank;

an account chip card storing at least said first biometric data;

a kiosk associated with said game unit, said kiosk including a biometric reader for receiving a biometric identifier of the player and a card reader for receiving said account chip card, at least one of said central server and said kiosk comparing said first biometric data with second biometric data extracted from said biometric identifier to determine comp points based on game play on said game unit, and at least one of said kiosk and said central server comparing said second biometric data and said first biometric data to determine access to said user financial account information.

18. The system of claim 17 further including a bank networked with said central server, at least one of said central server and said kiosk comparing said first biometric data with said second biometric data extracted from said biometric identifier to determine access to funds deposited in said bank.

19. The system of claim 17 further including a plurality of game units and a plurality of kiosks associated with said game units.

20. The system of claim 17 further including a plurality of game locations, each of said game locations including at least one server and a plurality of game units.

* * * * *